United States Patent [19]

Robert et al.

[11] 4,102,300

[45] Jul. 25, 1978

[54] APPARATUS FOR CONTINUOUSLY COATING A METAL WIRE AT HIGH VELOCITY

[75] Inventors: Philippe Robert, Epalinges, Switzerland; Claude Guignard, St. Genis Pouilly, France; Francis Stagoll, Grand-Lancy, Switzerland

[73] Assignees: S.A. des Câbleries & Tréfileries de Cossonay, Cossonay Gare; Société d'Exploitation des Câbles Electriques, Cortaillod; Câbleries de Brugg S.A., Brugg, all of Switzerland

[21] Appl. No.: 748,773

[22] Filed: Dec. 8, 1976

Related U.S. Application Data

[62] Division of Ser. No. 605,053, Aug. 15, 1975.

[30] Foreign Application Priority Data

Aug. 16, 1974 [CH] Switzerland ..... 11223/74

[51] Int. Cl.[2] ..... B05C 19/00

[52] U.S. Cl. ..... 118/67; 118/69; 118/405; 118/420; 118/DIG. 19

[58] Field of Search ..... 118/67, 69, 404, 405, 118/420, DIG. 19

[56] References Cited

U.S. PATENT DOCUMENTS

| | | | |
|---|---|---|---|
| 2,581,938 | 1/1952 | Swanson et al. | 118/420 |
| 3,045,640 | 7/1962 | Hill et al. | 118/404 X |
| 3,389,010 | 6/1968 | Burch | 118/405 X |
| 3,476,081 | 11/1969 | Facer et al. | 118/405 X |
| 3,503,778 | 3/1970 | Corbett et al. | 427/195 |
| 3,962,990 | 6/1976 | Phipps et al. | 118/404 X |

*Primary Examiner*—John P. McIntosh
*Attorney, Agent, or Firm*—Karl F. Ross

[57] ABSTRACT

A metal wire to be coated with thermoplastic material is advanced at high speed, e.g. of 100 meters per minute, through a codirectionally moving mass of thermoplastic particles after having been heated to a temperature high enough to cause adhesion of these particles to the wire. The mass is mechanically entrained in a treatment chamber by an endless belt or the like at a speed close enough to that of the wire to hold the velocity difference therebetween below a threshold value, such as 30 meters per minute, above which an abrasive effect sets in which tends to detach already adhering particles from the wire. Upon exiting from the treatment chamber, the wire is reheated to fuse these particles into a continuous envelope and is then subjected to an electrostatic flocking operation for studding the envelope with radially projecting cellulosic fibers forming a velvety coating thereon.

9 Claims, 6 Drawing Figures

APPARATUS FOR CONTINUOUSLY COATING A METAL WIRE AT HIGH VELOCITY

This is a division of application Ser. No. 605,053, filed Aug. 15, 1975.

FIELD OF THE INVENTION

Our present invention relates to an apparatus for continuously coating a metal wire with plastic material to form a protective and/or electrically insulating envelope therearound.

BACKGROUND OF THE INVENTION

It is known, e.g. from Swiss Pat. No. 560,953, to preheat a metal wire above the fusion point of a mass of thermoplastic particles through which heated wire is continuously passed so as to cause adhesion of some of the particles thereto. Upon emerging from that mass, the wire is reheated to fuse these adhering particles into a continuous envelope. It has also been proposed to coat various articles with thermally softenable particulate matter by suspending the comminuted coating material in a fluid, e.g. in a moving gas stream forming a fluidized bed, and exposing the articles to prolonged contact with the material so suspended.

In all these instances the rate of coating is limited by the existence of what may be termed an abrasive threshold, i.e. a velocity beyond which the article to be coated must not move through the mass lest particles already adhering to its surface be again dislodged therefrom by the impact of other, stationary or slow-moving particles colliding therewith. In the specific case here envisaged, i.e. the coating of a metal wire, this abrasive effect is found to increase with the wire velocity.

OBJECT OF THE INVENTION

It is, therefore, the object of our invention to provide an apparatus for enveloping metal wires with thermoplastic material at substantially higher rates than has heretofore been possible with the fusion-coating technique described above.

SUMMARY OF THE INVENTION

We realize this object, in accordance with the present invention, by continuously longitudinally advancing the preheated wire through a treatment zone in which a mass of thermoplastic particles, fusible at the wire temperature, is continuously moved codirectionally with the wire at a speed making the velocity of the wire relative to the thermoplastic mass less than the value representing the aforementioned abrasive threshold even though the absolute velocity of the wire exceeds that threshold value, being preferably at least double that value.

We have found that, with the usual thermoplastic materials including polyethylene, polystyrene, polyacrylates and linear polyamides such as nylon, the abrasive threshold is on the order of 30 meters per minute and that wire speeds of about 100 meters per minute may be conveniently realized with suitable particle velocities imparted to the mass (or to at least a portion thereof proximal to the wire) by preferably mechanical transport means such as an endless conveyor comprising a band with substantially horizontal upper and lower runs. With the upper run spaced from the wire by a fraction of a centimeter, the conveyor speed should be somewhat higher than the difference between the wire velocity and the threshold value in view of the speed gradient within the mass, i.e. the decrease of the particle speed with increasing distance from the conveyor surface.

Advantageously, pursuant to a further feature of our invention, the two runs of the conveyor are bracketed by two stationary sidewalls forming with the conveyor band a plenum chamber which accommodates a transmission drivingly linking the conveyor band with an external motor, the plenum chamber communicating with a source of compressed air or other high-pressure fluid to prevent the entry of plastic particles which could damage the transmission or impair its operation.

BRIEF DESCRIPTION OF THE DRAWING

The above and other features of our invention will now be described in detail with reference to the accompanying drawing in which.

SPECIFIC DESCRIPTION

Figure 1:
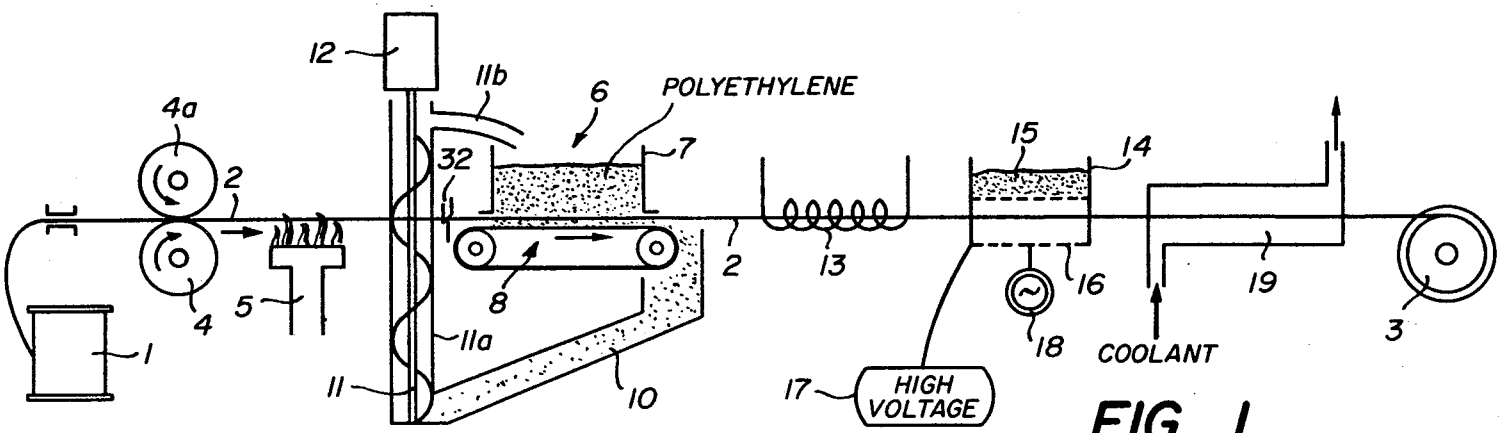
FIG. 1 is a diagrammatic view of a wire-coating apparatus embodying our invention.

In FIG. 1 we have shown, by way of illustration, an apparatus for coating a wire with an insulating envelope to form a conductor for an electrical cable in which the spaces between adjoining conductors are filled with cellulosic fibers projecting generally radially from their envelopes wherein they are partially imbedded, for the purpose of impeding moisture penetration in the event of a rupture of the cable sheath, as described in U.S. patent application Ser. No. 388,589 filed Aug. 15, 1973 by Gerard Chevrolet et al. abandoned and replaced by application Ser. No. 638,639 filed Nov. 26, 1975, now U.S. Pat. No. 3,999,003. The studding of the wire envelope with these fibers, designed to form a velvety surface coating, does not form part of our invention.

Figure 2:
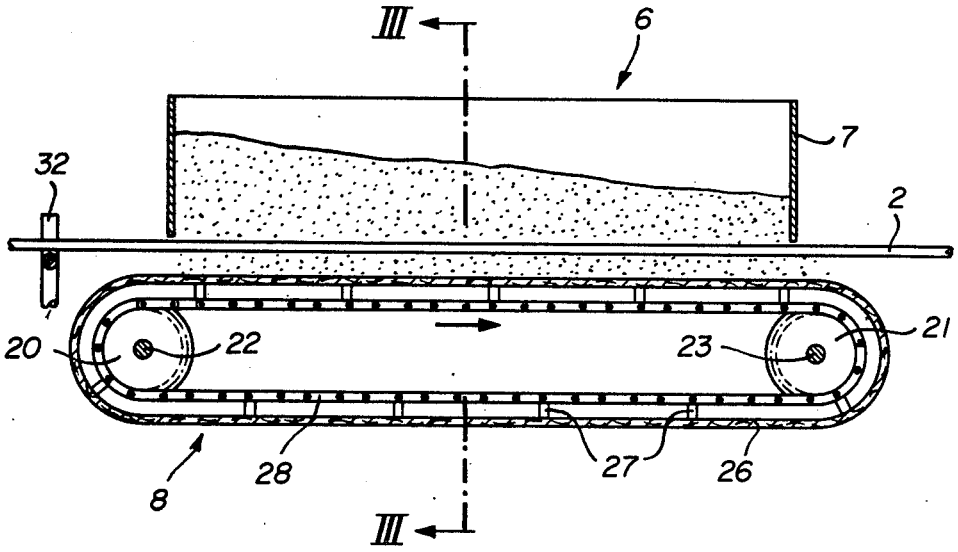
FIG. 2 is a longitudinal sectional view, drawn to a larger scale, of a treatment chamber forming part of the apparatus of FIG. 1.
Figure 3:
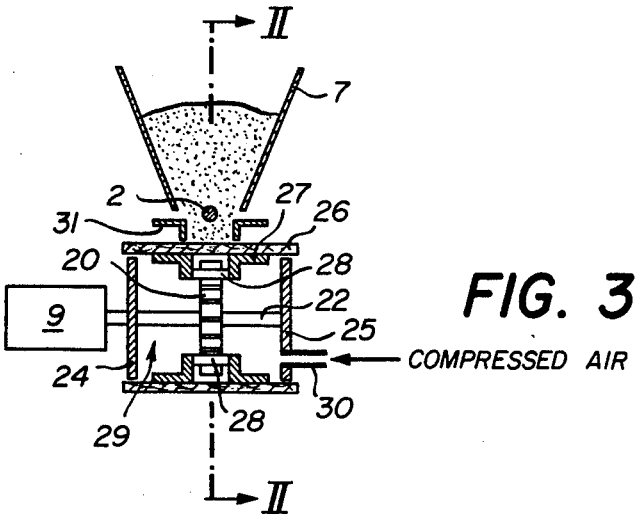
FIG. 3 is a cross-sectional view taken on the line III—III of FIG. 2.

A copper wire 2 is drawn continuously from a supply reel, 1 by a feed roller 4, coacting with a counterroller **4*a*, which advances the wire at an elevated axial speed through a cascade of stages 5, 6, 13, 14 and 19 to a take-up station in the form of a continuously rotating capstan 3. Stage 5 is a preheater, represented by a gas burner, which raises the temperature of the wire above the fusion point of a thermoplastic material such as polyethylene preparatorily to the passage of the wire through a treatment zone in the immediately following stage 6. That stage comprises a treatment chamber defined in this instance by the lower end of a hopper 7 and the horizontal upper run of a solid conveyor band 26 (FIGS. 2 and 3), forming part of a transporter 8, supported by outwardly projecting lugs 27 with flat outer faces secured to links of an endless chain 28. The chain 28 is engaged by a pair of sprockets horizontally spaced apart in the direction of wire motion, i.e. a driving sprocket 20 on a shaft 22 and an idler sprocket 21 on a shaft 23. An external motor 9 (FIG. 3) is coupled with the drive shaft 22 which, like idler shaft 23, is journaled in a pair of sidewalls 24, 25 bracketing the band 26 to form therewith a substantially closed plenum chamber 29. An inlet 30 communicates with a source of compressed air to maintain the interior of chamber 29 substantially free of particles of polyethylene powder occupying the hopper 7 and the treatment chamber which is bounded in part by a pair of stationary brackets 31 designed to prevent the lateral escape of the powder issuing from the hopper. A fork 32, engaging the wire 2 upstream of the treatment chamber, maintains the necessary spacing (e.g. of 5 to 6 mm) between the wire and the conveyor band 26**.

Excess powder, which does not adhere to the heated wire 2, drops at the discharge end of transporter 8 into a chute 10 which passes underneath the conveyor band 26 and terminates at the bottom end of a vertical tube 11*a* containing a feed screw 11 driven by a motor 12. The feed screw elevates the unutilized particles above the level of hopper 7 for recirculating same, via a spout 11*b*, to the treatment chamber.

The length of the treatment chamber and, therefore, of the conveyor should be sufficient to allow the fusion of a sufficient quantity of powder by the heat of the traversing wire to coat that wire to the desired depth. Moreover, the conveyor speed must be high enough to reduce the speed difference between the wire 2 and the codirectionally moving polyethylene mass in the immediate vicinity of the wire to less than the aforedescribed threshold value of approximately 30 meters per minute. Thus, with the wire moving at 100 meters per minute, the conveyor speed should be not less than about 80 meters per minute.

In a specific instance, the polyethylene had particles sizes ranging between 20 and 200 $\mu$, a density of 0.915 grams per $cm^3$, and a melting point between 100° and 103°, with a fusion rate of 20 grams per minute.

The adhering polyethylene particles are subjected to reheating in stage 13, represented by a heating coil, so as to flow and fuse into a continuous envelope around the wire 2. Stage 14 is an electrostatic flocking unit forming a reservoir for a mass of cellulosic fibers 15, of about 0.5 mm length, overlying a perforated cylindrical electrode 16 which surrounds the coated wire and is connected to a high-voltage power supply 17 for establishing a radially oriented field around the wire. The fibers 15, uniformly distributed over the surface of the still soft wire envelope by a vibrator 18, partly imbed themselves in that envelope while positioning themselves in the direction of the electric field. Vibrator 18 may oscillate at the frequency of a commercial electrical network, generally at 50 or 60 Hz, with an amplitude between about 0.1 and 0.3 mm. Electrode 16 may also be split into two half-shells spaced apart along a median plane to form gaps for the admission of the fibers.

The final stage 19 is a channel traversed by a cooling fluid for rapid hardening of the fiber-studded plastic wire envelope.

Figure 5:
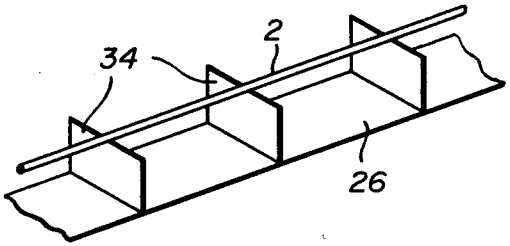
FIG. 5 is a view similar to FIG. 4, showing a modified conveyor band.
Figure 4:
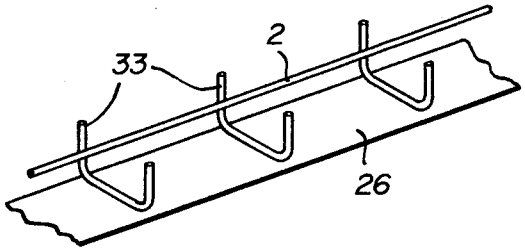
FIG. 4 is a fragmentary perspective view of a conveyor band adapted to be used in the treatment chamber of FIGS. 2 and 3.

The surface of conveyor band 26 should be sufficiently rough to insure proper entrainment of the powder particles in the direction of wire motion. For a more positive acceleration of these particles by the conveyor, band 26 may be provided with equispaced, outwardly projecting surface formations such as stirrups 33 (FIG. 4) or fins 34 (FIG. 5) lying in planes transverse to the band surface. In either case these formations should be spaced from the wire 2 so as to avoid any scraping action.

Figure 6:
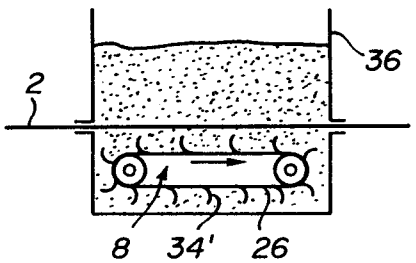
FIG. 6 is a schematic view of a modified treatment chamber for the apparatus of FIG. 1.

Instead of flat fins, forwardly concave scoops 34' may be used as shown in FIG. 6. That Figure also illustrates the possibility of enveloping the entire transporter 8 in the mass of polyethylene powder within a treatment chamber 36, thereby eliminating the need for a hopper 7 and the recirculating mechanism 10, 11. Naturally, the conveyor band 26 may also in this case be equipped with stirrups 33 or fins 34, or simply roughened on its outer surface.

Conveyor band 26 represents a preferred example of a variety of mechanical transport means suitable for the practice of our invention. Other devices of this character (e.g. feed screws) can also be used to displace a thermoplastic powder codirectionally with a heated wire, at the requisite speed, in a treatment zone.

We claim:

1. An apparatus for coating a metal wire with thermoplastic material, comprising:

a supply station and a take-up station defining a path for a wire stretched therebetween;

feed means engaging said wire for continuously longitudinally advancing same along said path at an absolute velocity exceeding a threshold value above which a surrounding mass of stationary thermoplastic particles would exert a significant abrasive effect;

a treatment chamber between said stations traversed by said wire and filled with a mass of thermoplastic particles;

preheating means along said path upstream of said treatment chamber for raising the temperature of said wire to a level sufficient to cause adherence of some of said particles thereto;

transport means independent of said feed means disposed at least partly in said chamber for continuously moving at least a portion of said mass proximal to said wire codirectionally therewith at a speed different from the velocity of said wire but with a speed difference less than said threshold value to prevent the occurrence of said abrasive effect; and reheating means along said path downstream of said treatment chamber for fusing adhering particles on said wire into a continuous envelope.

2. An apparatus as defined in claim 1, further comprising forced-cooling means for said wire downstream of said reheating means.

3. An apparatus as defined in claim 1 wherein said transport means comprises a mechanical transporter.

4. An apparatus as defined in claim 3 wherein said transporter comprises an endless conveyor band with substantially horizontal upper and lower runs bracketed by a pair of stationary walls and forming therewith a plenum chamber, and transmission means in said plenum chamber drivingly connected with said conveyor band.

5. An apparatus as defined in claim 4, further comprising a source of high-pressure fluid communicating with said plenum chamber for preventing the entry of thermoplastic particles thereinto.

6. An apparatus as defined in claim 4, further comprising recirculation means for returning nonadhering particles from a discharge end of said conveyor band to said treatment chamber.

7. An apparatus as defined in claim 6 wherein said recirculation means comprises a chute bypassing said plenum chamber and extending beneath said lower run, and a feed screw extending from said chute to a level above said treatment chamber.

8. An apparatus as defined in claim 4 wherein said conveyor band is provided with longitudinally equispaced surface formations assisting in the entrainment of said particles through said treatment chamber.

9. An apparatus as defined in claim 4 wherein said conveyor band is entirely disposed in said treatment chamber.

* * * * *